US005240150A

United States Patent [19]

Palmon

[11] Patent Number: 5,240,150

[45] Date of Patent: Aug. 31, 1993

[54] ICE CUBE STORAGE APPARATUS

[76] Inventor: Ophir Palmon, 13 Orchard Dr., Gaithersburg, Md. 20878

[21] Appl. No.: 835,363

[22] Filed: Feb. 14, 1992

[51] Int. Cl.[5] ..... B65D 81/18

[52] U.S. Cl. ..... 222/216; 222/415; 62/344

[58] Field of Search ..... 220/662, 676; 62/344; 222/146.6, 158, 185, 216, 415

[56] References Cited

U.S. PATENT DOCUMENTS

| | | | |
|---|---|---|---|
| 1,360,422 | 11/1920 | Lyon | 222/415 |
| 3,062,413 | 11/1962 | Adams et al. | 222/185 |
| 3,135,436 | 6/1964 | Golay | 222/415 X |
| 3,514,964 | 6/1970 | Dodge, III et al. | 62/344 X |
| 3,717,286 | 2/1973 | Crider | 222/185 X |
| 3,892,337 | 7/1975 | Neumann | 62/344 X |
| 4,789,130 | 12/1988 | Stich et al. | 62/344 X |
| 4,889,263 | 12/1989 | Ellis et al. | 222/185 |
| 4,997,109 | 3/1991 | Carper | 222/146.6 |
| 5,105,991 | 3/1992 | Johnson | 222/185 |
| 5,139,173 | 8/1992 | Evinger | 222/185 |

*Primary Examiner*—Andres Kashnikow
*Assistant Examiner*—Kenneth Bomberg
*Attorney, Agent, or Firm*—Leon Gilden

[57] ABSTRACT

A container housing is arranged with a front wall slot directed through the front wall of the container, with a deflector plate extending rearwardly and canted downwardly relative to an upper edge of the front wall slot. Access to the floor of the associated container is directed through the slot, with a ramp structure to include a ramp plate, or alternatively a conveyor belt directed downwardly from the rear wall towards the floor. The ramp structure may include a conveyor assembly, with the conveyor assembly including a non-freezable gel therewithin, whereupon on cleaning of the container, heating of the non-freezable gel enhances ease of maintenance of the organization in use.

2 Claims, 4 Drawing Sheets

ICE CUBE STORAGE APPARATUS

BACKGROUND OF THE INVENTION

1. Field of the Invention

The field of invention relates to ice cube tray structure, and more Particularly pertains to a new and improved ice cube storage apparatus wherein the same is arrange for the storage and accessibility of ice cubes therewithin.

2. Description of the Prior Art

Conventional ice cube containers are arranged to receive conventional ice cube trays at an upper edge thereof, wherein removal of the tray structure is required for access interiorly of the prior art containers. The instant invention attempts to overcome deficiencies of the Prior art by utilizing a slot directed through a front wall of the container eliminating need for removal of ice cube trays Positioned thereon. A rear ramp structure is arranged to direct ice cubes towards the slot.

Prior art apparatus relative to ice tray structure is exemplified in the U.S Pat. Nos. 4,777,992; 4,177,652; 3,796,063; and 4,565,074 wherein Prior art structure sets forth either an elaborate organization or an organization not permitting ease of access to storage container ice cube components without removal of ice cube trays to an upper edge thereof.

As such, it may be appreciated that there continues to be a need for a new and improved ice cube storage apparatus as set forth by the instant invention which addresses both the problems of ease of use as well as effectiveness in construction and in this respect, the Present invention substantially fulfills this need.

SUMMARY OF THE INVENTION

In view of the foregoing disadvantages inherent in the known types of ice cube storage apparatus now present in the prior art, the present invention provides an ice cube storage apparatus wherein the same utilizes ease of access interiorly of the container through a front wall slot thereof. As such, the general purpose of the Present invention, which will be described subsequently in greater detail, is to provide a new and improved ice cube storage apparatus Which has all the advantages of the prior art ice cube storage apparatus and none of the disadvantages.

To attain this, the present invention provides a container housing arranged with a front wall slot directed through the front wall of the container, with a deflector plate extending rearwardly and canted downwardly relative to an upper edge of the front wall slot. Access to the floor of the associated container is directed through the slot, with a ramp structure to include a ramp Plate, or alternatively a conveyor belt directed downwardly from the rear wall towards the floor. The ramp structure may include a conveyor assembly, with the conveyor assembly including a non-freezable gel therewithin, whereupon on cleaning of the container, heating of the nonfreezable gel enhances ease of maintenance of the organization in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the Present invention. It is important, therefore, that the claims be regarded as including such equivalent constructions insofar as they do not depart from the spirit and scope of the Present invention.

Further, the purpose of the foregoing abstract is to enable the U.S. Patent and Trademark Office and the Public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the Present invention to provide a new and improved ice cube storage apparatus which has all the advantages of the Prior art ice cube storage apparatus and none of the disadvantages.

It is another object of the Present invention to provide a new and improved ice cube storage apparatus which may be easily and efficiently manufactured and marketed.

It is a further object of the Present invention to provide a new and improved ice cube storage apparatus which is of a durable and reliable construction.

An even further object of the Present invention is to provide a new and improved ice cube storage apparatus which is susceptible of a low cost of manufacture with regard to both materials and labor, and which accordingly is then susceptible of low prices of sale to the consuming public, thereby making such ice cube storage apparatus economically available to the buying public.

Still yet another object of the present invention is to provide a new and improved ice cube storage apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated Preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
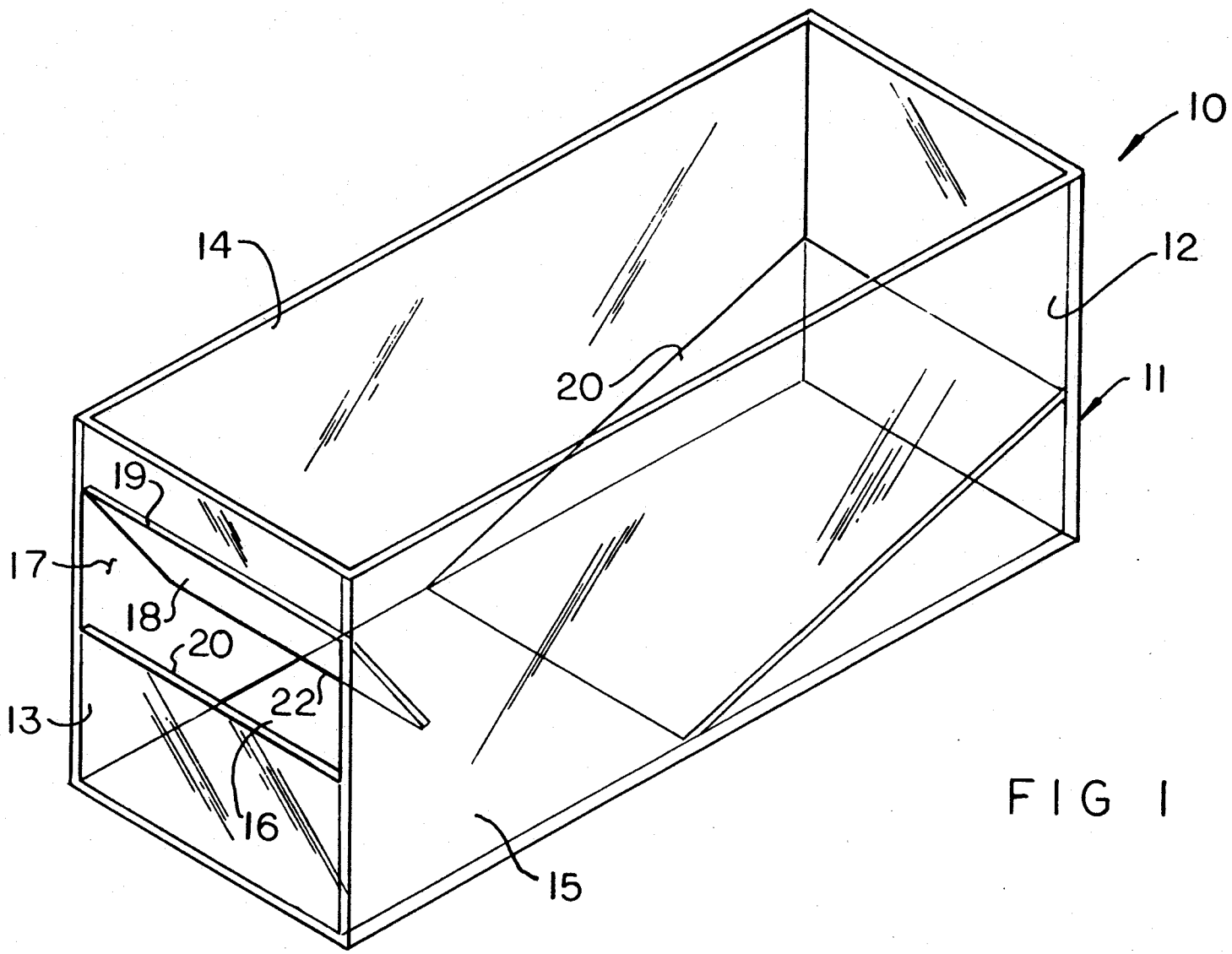
FIG. 1 is an isometric illustration of the instant invention.
Figure 2:
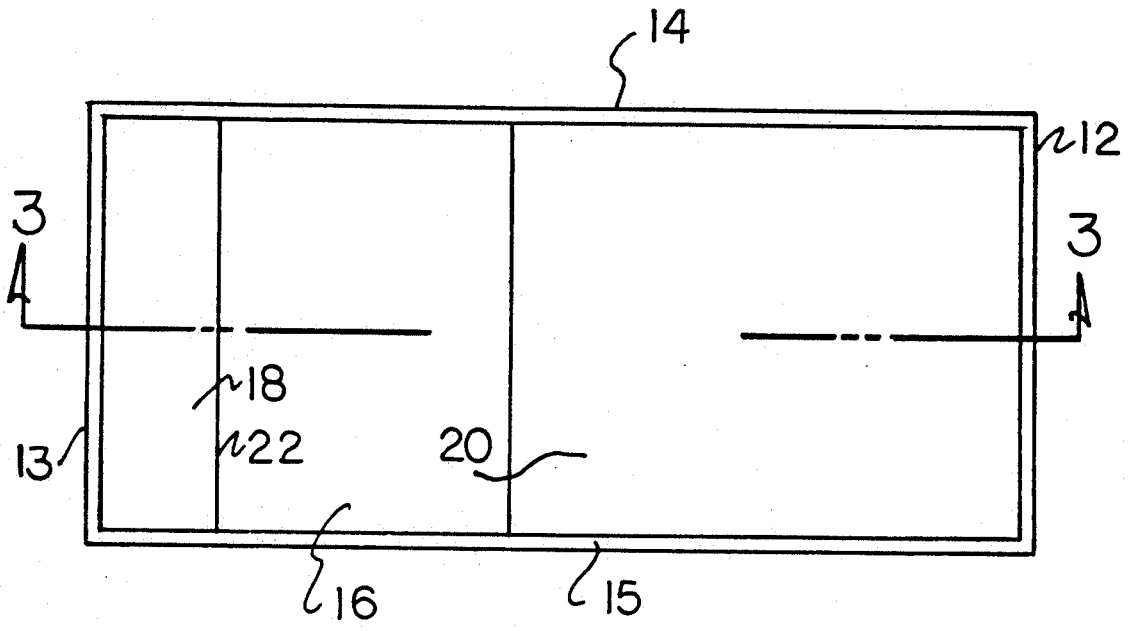
FIG. 2 is an orthographic top view of the instant invention.
Figure 3:
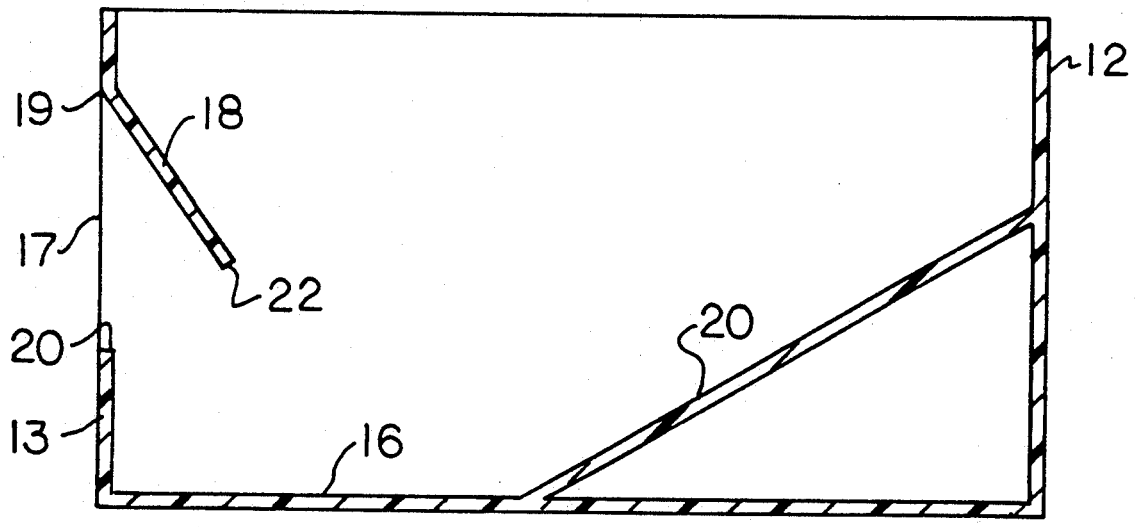
FIG. 3 is an orthographic view, taken along the lines 3—3 of FIG. 2 in the direction indicated by the arrows.

With reference now to the drawings, and in particular. to FIGS. 1 to 6 thereof, a new and improved ice cube storage apparatus embodying the principles and concepts of the present invention and generally designated by the reference numerals 10 and 10a will be described.

More specifically, the ice cube storage apparatus 10 of the instant invention essentially comprises a transparent housing 11 to include a front wall 13 spaced from and parallel a rear wall 12, and a first side wall 14 spaced from a second side wall 15, with the housing 11 including a floor 16 directed coextensively between lower distal ends of the wall structure, as illustrated. A front wall slot 17 is directed through the front, wall, with the front wall slot 17 including a slot bottom edge 20 spaced from a slot top edge 19. A front wall deflector plate 18 cants interiorly of the housing 11 from the slot top edge 19, with the deflector Plate 1B extending coextensively relative to the slot top edge 19 and the deflector Plate 18 including a deflector plate lower distal edge 22 spaced interiorly of the housing relative to the slot bottom edge 20. A ramp plate 20 fixedly mounted to an interior surface of the rear wall 12 cants downwardly towards the floor 16, with the lower edge of the ramp plate 20 spaced from the deflector Plate lower distal edge 22 to effect access interiorly of the housing 11 through the slot, with the ramp plate directing ice cubes from storage therewithin (not shown) towards the slot opening 17. Further, the continuous coplanar perimeter edge of the side wall structure of the housing permits positioning of ice cube trays (not shown) of conventional construction to position upon the top edge.

Figure 4:
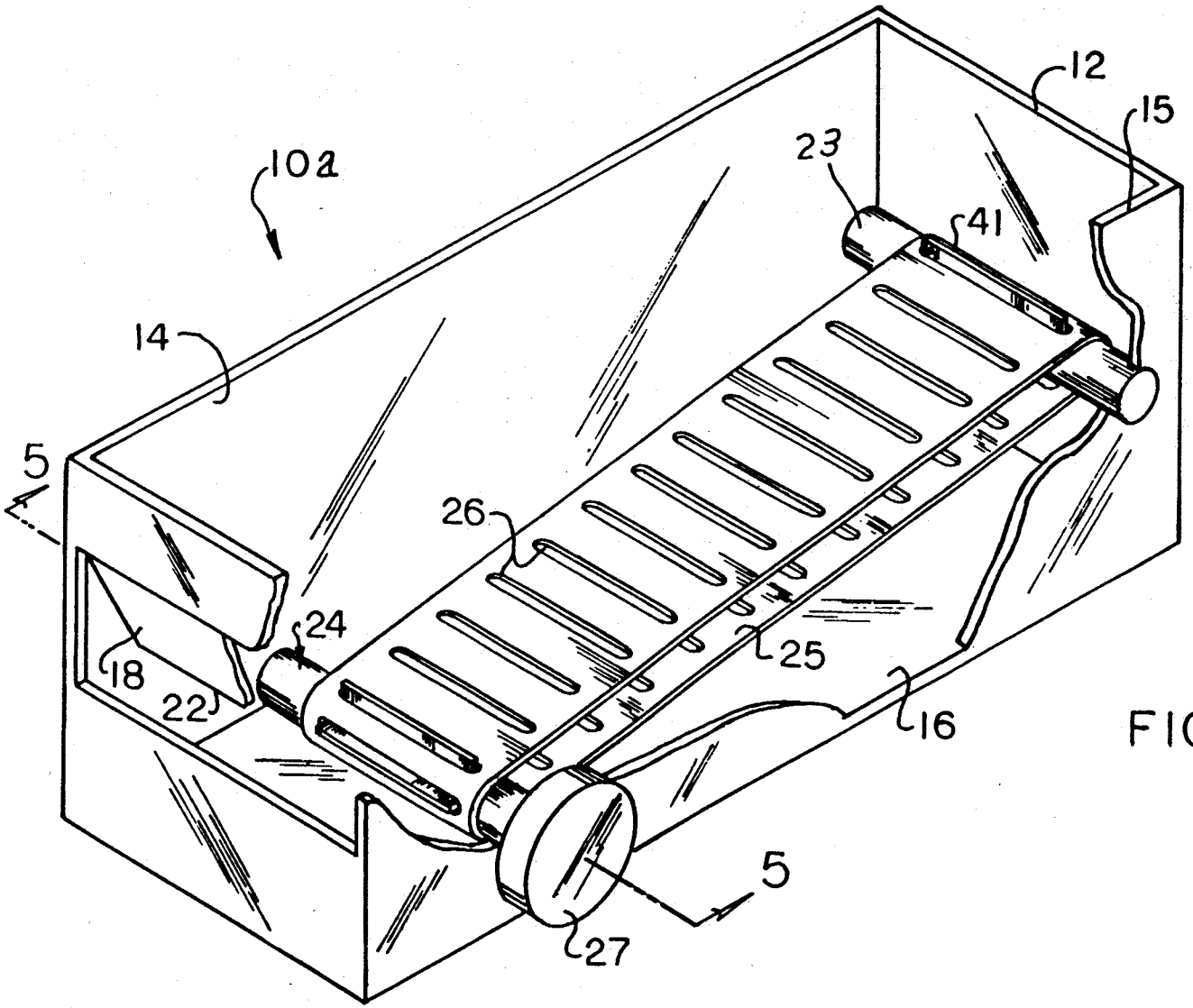
FIG. 4 is an isometric illustration of a modification of the invention.
Figure 5:
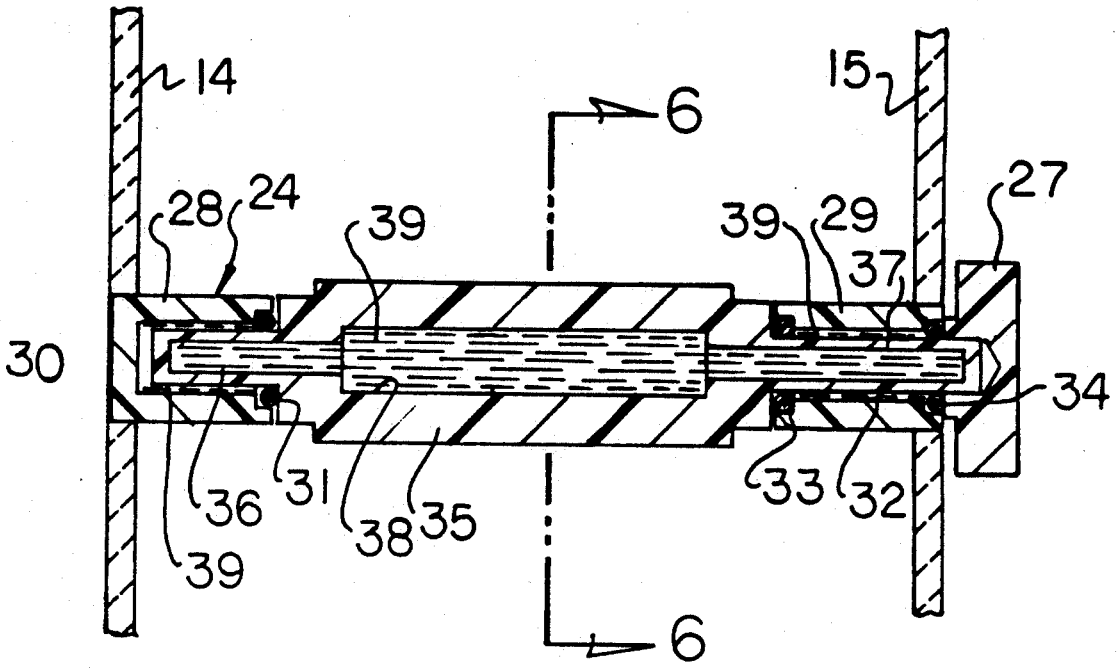
FIG. 5 is an orthographic view, taken along the lines 5—5 of FIG. 4 in the direction indicated by the arrows.
Figure 6:
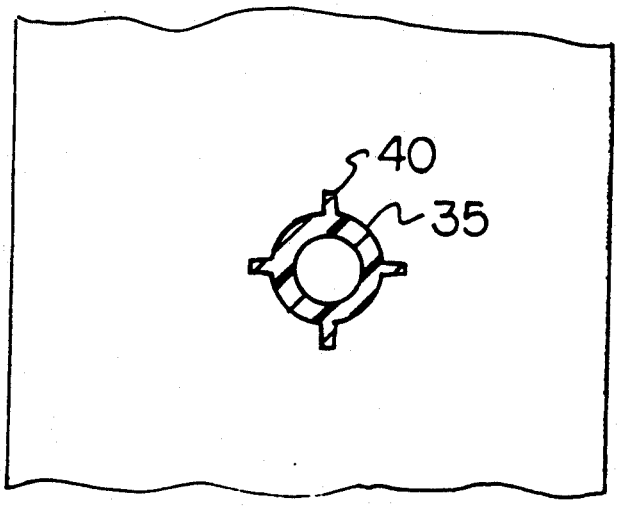
FIG. 6 is an orthographic view, taken along the lines 6—6 of FIG. 5 in the direction indicated by the arrows.

A modified apparatus 10a is illustrated in the FIGS. 4–6 to include in lieu of the ramp Plate 20, a continuous conveyor belt 25 that cants downwardly towards the floor 16 from the interior surface of the rear wall 12. A first axle 23 orthogonally directed through the first and second side walls 14 and 15 is spaced above and parallel a second axle 24. The conveyor belt 25 is formed with spaced parallel slots 26 extending orthogonally between side edges of the conveyor belt 25. A handle 27 orthogonally mounted to a first end of the second axle 24 is Positioned exteriorly of the second side wall 15. An axle hub 28 fixedly mounted to an interior surface of the first side wall 14 is coaxially aligned with an axle bushing 29 orthogonally mounted through the second side wall 15. The axle hub 28 includes an axle hub cavity 30 formed with an axle hub seal 31 at an entrance to the cavity 30. The bushing 29 includes a bushing cavity 32 directed therethrough, with first and second bushing seals 33 and 34 Positioned at opposed entrance ends to the bushing cavity 32, with the use of an axle support shaft 35 extending between the axle hub 28 and the axle bushing 29, including a first stub shaft 36 Positioned within the axle hub cavity, and a second stub shaft 37 directed through the bushing cavity 32. The axle support shaft 35 includes a fluid cavity 38 therewithin, with the fluid cavity 38' the bushing cavity 32, and the axle hub cavity 30 each including antifreeze gel or fluid 39 therewithin. The fluid Permits ease of maintenance of the organization, whereupon during a cleaning procedure, an individual need not wait for the defrosting process but may merely use microwave heating for a short time to effect heating of the antifreeze solution 39. The antifreeze solution may be of any commercial available type or may utilize a consumable mixture such as sugar, salt, and the like in solution. Further, the axle hub cavity 30 and the bushing cavity 32 including the antifreeze solution therewithin minimize freezing fluid from entering the interface between the first and second stub shafts 36 and 37 and the respective first and second axle hub cavity 30 and bushing cavity 32 preventing ease of rotation of the second axle 24.

Axle support ribs 40 are arranged parallel relative to the longitudinal axis of the axle support shaft 35, wherein each of the support ribs 40 are spaced for projection within the associated slots 26 to effect rotation of the slots during use. Similarly, the first axle 33 may be optionally formed with such further ribs 41 to Provide for registration of the conveyor belt between the first and second axles 23 and 24 in use with the conveyor belt structure.

As to the manner of usage and operation of the instant invention, the same should be apparent from the above disclosure, and accordingly no further discussion relative to the manner of usage and operation of the instant invention shall be provided.

With respect to the above Description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An ice cube storage apparatus, comprising:

a transparent housing, the transparent housing including a rear wall spaced from a front wall, a first side wall spaced from and parallel a second side wall.

and a floor integrally mounted to the transparent housing coextensive therewithin to define a housing cavity within the transparent housing, and the transparent housing including a front wall slot, the front wall slot extending between the first side wall and the second side wall through the front wall, the front wall slot including a slot top edge spaced from and parallel a slot bottom edge, and the front wall slot includes a deflector plate, the deflector plate integrally and coextensively mounted to the slot top edge canted interiorly of the housing cavity, with the deflector plate terminating in a deflector plate lower distal edge positioned within the housing cavity spaced from the slot bottom edge, and a ramp member positioned within the housing cavity extending from the rear wall to the floor, with the ramp member spaced from the housing front wall, and the ramp member including a first axle rotatably mounted within the housing cavity orthogonally directed from the first side wall through the second side wall, and a second axle spaced from and parallel the first axle the second axle positioned adjacent the floor, wherein the second axle is orthogonally directed between the first side wall and the second side wall, and the second axle including a second axle handle fixedly mounted to the second axle positioned exteriorly of the second side wall, and a continuous conveyor belt extending between the first axle and the second axle wound about the first axle and the second axle, and the second axle includes an axle hub orthogonally mounted to the first side wall, and an axle bushing orthogonally mounted to the second side wall, wherein the axle hub and axle bushing are coaxially aligned, and the axle hub including an axle hub cavity, and the axle bushing including a bushing cavity, and the axle hub including an axle hub seal positioned at an entrance to the axle hub cavity, and the axle bushing including an axle bushing first seal spaced from an axle bushing second seal positioned on opposed ends of the bushing cavity, and an axle support shaft positioned between the axle hub and the axle bushing, the axle support shaft including a first stub shaft rotatably mounted within the axle hub cavity, and the axle support shaft including an axle support second stub shaft directed through the axle bushing cavity, and the axle hub cavity including a first antifreeze solution positioned about the first stick shaft, and a second antifreeze solution positioned within the axle bushing cavity about the second stub shaft, and the axle support shaft including an axle support shaft cavity, and a third anti-freeze solution contained within the axle support fluid cavity.

2. An apparatus as set forth in claim 1 wherein the axle support shaft includes a plurality of spaced parallel ribs, the spaced parallel ribs arranged parallel to an axle support shaft axis of the axle support shaft, and the first axle including first axle ribs parallel to each other and to the axle support shaft ribs, and the conveyor belt including spaced parallel conveyor belt slots orthogonally directed between opposed side edges of the conveyor belt to receive the ribs.

* * * * *